US009001499B2

(12) United States Patent
Kolberg et al.

(10) Patent No.: US 9,001,499 B2
(45) Date of Patent: Apr. 7, 2015

(54) JUMPER FOR ELECTRICALLY CONNECTING ELECTRICAL SWITCHING APPARATUS POLES, AND ELECTRICAL SWITCHING APPARATUS INCLUDING THE SAME

(75) Inventors: Kenneth D. Kolberg, Robinson Township, PA (US); Thomas M. Whalen, Cranberry Township, PA (US); John J. Shea, Pittsburgh, PA (US); Percy J. Lipsey, Aliquippa, PA (US)

(73) Assignee: Eaton Corporation, Cleveland, OH (US)

( * ) Notice: Subject to any disclaimer, the term of this patent is extended or adjusted under 35 U.S.C. 154(b) by 424 days.

(21) Appl. No.: 13/402,239

(22) Filed: Feb. 22, 2012

(65) Prior Publication Data

US 2013/0213780 A1 Aug. 22, 2013

(51) Int. Cl.

| | |
|---|---|
| ***H01H 1/58*** | (2006.01) |
| ***H01H 71/08*** | (2006.01) |
| ***H01H 9/52*** | (2006.01) |
| ***H01H 71/10*** | (2006.01) |
| *H01H 33/66* | (2006.01) |

(52) U.S. Cl.

CPC ..... *H01H 71/082* (2013.01); *H01H 9/52* (2013.01); *H01H 71/1045* (2013.01); *H01H 2033/6613* (2013.01)

(58) Field of Classification Search

CPC ..... H01H 1/082; H01H 9/52; H01H 71/1045; H01H 2033/6613

USPC ..... 361/676, 678

See application file for complete search history.

(56) References Cited

U.S. PATENT DOCUMENTS

| | | | | | |
|---|---|---|---|---|---|
| 2,870,240 | A | * | 1/1959 | Stieglitz | 174/88 R |
| 3,333,159 | A | * | 7/1967 | Niemoller | 361/624 |
| 3,621,108 | A | * | 11/1971 | Cleaveland | 174/5 R |
| 3,829,647 | A | * | 8/1974 | Cleaveland | 200/289 |
| 3,879,100 | A | | 4/1975 | Chabot | |
| 3,909,097 | A | * | 9/1975 | Roth et al. | 439/511 |
| 3,958,093 | A | * | 5/1976 | Cleaveland | 218/118 |
| 3,961,129 | A | * | 6/1976 | Gehrs et al. | 174/72 B |
| 4,005,297 | A | * | 1/1977 | Cleaveland | 218/118 |
| 4,639,819 | A | * | 1/1987 | Kirby | 361/115 |
| 4,945,188 | A | * | 7/1990 | Jackson | 174/16.2 |
| 5,064,384 | A | * | 11/1991 | Weaver | 439/511 |
| 5,094,626 | A | * | 3/1992 | Fabrizi et al. | 439/511 |

(Continued)

FOREIGN PATENT DOCUMENTS

| | | | |
|---|---|---|---|
| EP | 1 630 916 | A1 | 3/2006 |
| WO | 2009/074016 | A1 | 6/2009 |

OTHER PUBLICATIONS

European Patent Office, "International Search Report and Written Opinion", Jan. 16, 2013, 9 pp.

*Primary Examiner* — Anatoly Vortman

(74) *Attorney, Agent, or Firm* — Eckert Seamans Cherin & Mellott, LLC; Kirk D. Houser

(57) ABSTRACT

An electrical switching apparatus includes a plurality of poles, each of the poles including a terminal. The terminal of a first one of the poles is proximate the terminal of a second one of the poles. A jumper is electrically connected between the terminal of the first one of the poles and the terminal of the second one of the poles. The jumper includes a plurality of heat transfer members, each of the heat transfer members being separated from others of the heat transfer members.

15 Claims, 4 Drawing Sheets

(56) References Cited

U.S. PATENT DOCUMENTS

| | | | | |
|---|---|---|---|---|
| 5,902,156 | A * | 5/1999 | Geebelen et al. | 439/714 |
| 6,565,394 | B2 | 5/2003 | Seff et al. | |
| 6,589,071 | B1 * | 7/2003 | Lias et al. | 439/511 |
| 6,614,334 | B1 | 9/2003 | Gibson et al. | |
| 6,692,296 | B2 | 2/2004 | Lias et al. | |
| 7,239,502 | B1 | 7/2007 | Seff et al. | |
| 7,400,495 | B1 | 7/2008 | Ranta et al. | |
| 7,422,491 | B2 * | 9/2008 | Gherardini | 439/721 |
| 8,717,746 | B2 * | 5/2014 | Kaufmann et al. | 361/678 |
| 2001/0027872 | A1 * | 10/2001 | Wagener | 174/71 B |
| 2003/0106785 | A1 * | 6/2003 | Bach et al. | 200/51.1 |
| 2008/0030930 | A1 * | 2/2008 | Adunka et al. | 361/611 |
| 2010/0302715 | A1 * | 12/2010 | Bortoli et al. | 361/676 |
| 2013/0250490 | A1 * | 9/2013 | Kaufmann et al. | 361/677 |

* cited by examiner

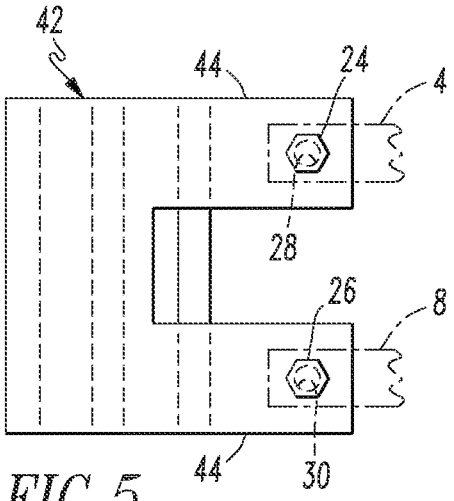
FIG. 5
FIG. 6
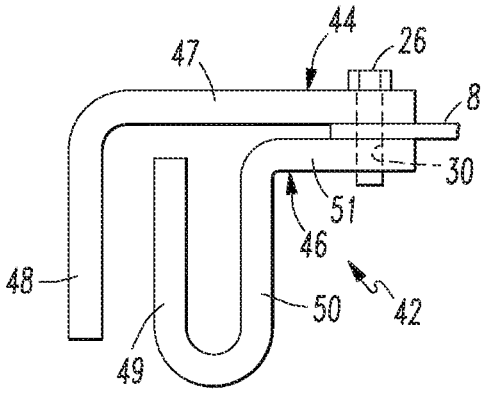
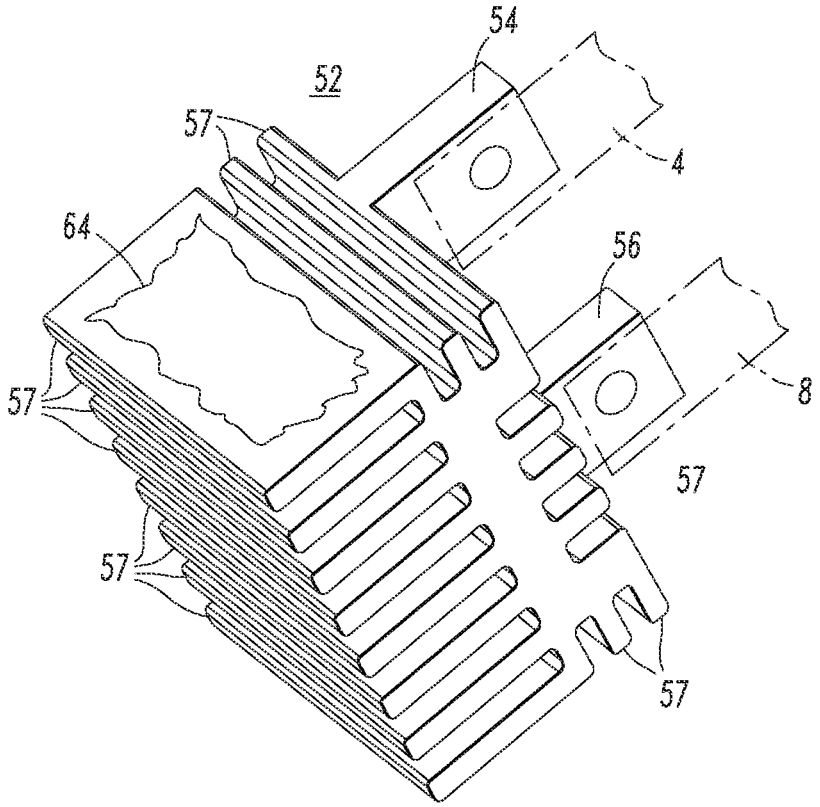
FIG. 7

JUMPER FOR ELECTRICALLY CONNECTING ELECTRICAL SWITCHING APPARATUS POLES, AND ELECTRICAL SWITCHING APPARATUS INCLUDING THE SAME

BACKGROUND

1. Field

The disclosed concept pertains generally to electrical switching apparatus and, more particularly, to circuit interrupters, such as, for example, circuit breakers. The disclosed concept further pertains to jumpers for electrical switching apparatus poles.

2. Background Information

U.S. Pat. No. 6,614,334 discloses a series arrangement of two circuit breaker mechanisms. The interruption performance of the circuit breaker is determined by the "current limitation of series arcs," which provides two arcs in series, thereby having twice the resistance of a single arc.

It is known to connect multiple poles of circuit breakers in series to provide a high voltage for a low voltage switching and interruption device (e.g., without limitation, 750 VDC; 1000 VDC; 1500 VAC).

Circuit breakers are typically available in one-, two-, three- and four-pole construction, although larger counts of poles are possible.

For a 1000 VDC application, typically multiple circuit breakers are electrically tied together. Most known existing six-pole or eight-pole air circuit breakers are designed such that the poles are electrically connected internally in breaker structures in a predetermined manner.

It is known that to obtain higher interruption and voltage ratings, circuit breaker poles can be wired in series. Normally, cable or bus bars are electrically connected to the circuit breaker terminals, which carry the current and remove a significant amount of the heat that is generated within the breaker. A conventional shorting strap (or jumper) electrically connected between poles can carry the current, but does not remove much heat, resulting in relatively high temperature rises at the circuit breaker terminals.

There is room for improvement in electrical switching apparatus, such as circuit breakers.

SUMMARY

These needs and others are met by embodiments of the disclosed concept, which provide both a current carrying function and a heat transfer function within a relatively small available space.

In accordance with one aspect of the disclosed concept, an electrical switching apparatus comprises: a plurality of poles, each of the poles comprising a terminal, the terminal of a first one of the poles being proximate the terminal of a second one of the poles; and a jumper electrically connected between the terminal of the first one of the poles and the terminal of the second one of the poles, the jumper comprising a plurality of heat transfer members, each of the heat transfer members being separated from others of the heat transfer members.

As another aspect of the disclosed concept, an electrical switching apparatus comprises: a plurality of poles; a plurality of pairs of separable contacts; a plurality of terminals electrically connected to the pairs of separable contacts; and a number of jumpers electrically connected to at least some of the plurality of terminals, each of the number of jumpers electrically connecting two of the pairs of separable contacts in series, and each of the number of jumpers comprising a plurality of heat transfer members, each of the heat transfer members being separated from others of the heat transfer members.

As another aspect of the disclosed concept, a jumper is for an electrical switching apparatus comprising a plurality of poles, each of the poles comprising a plurality of terminals, one of the terminals of a first one of the poles being proximate one of the terminals of a second one of the poles. The jumper comprises: a jumper member structured to be electrically connected between the one of the terminals of the first one of the poles and the one of the terminals of the second one of the poles, the jumper member comprising: a plurality of heat transfer members, wherein each of the heat transfer members is separated from others of the heat transfer members.

BRIEF DESCRIPTION OF THE DRAWINGS

A full understanding of the disclosed concept can be gained from the following description of the preferred embodiments when read in conjunction with the accompanying drawings in which:

FIG. 5 is a plan view of a jumper for electrical connection between a terminal of one pole and a terminal of another pole of a plural-pole electrical switching apparatus in accordance with another embodiment of the disclosed concept.

FIG. 6 is a vertical elevation view of the jumper engaging a terminal of one of the poles of the electrical switching apparatus of FIG. 5.

FIG. 7 is an isometric view of a jumper for electrical connection between a terminal of one pole and a terminal of another pole of a plural-pole electrical switching apparatus in accordance with another embodiment of the disclosed concept.

DESCRIPTION OF THE PREFERRED EMBODIMENTS

As employed herein, the term "number" shall mean one or an integer greater than one (i.e., a plurality).

As employed herein, the statement that two or more parts are "connected" or "coupled" together shall mean that the parts are joined together either directly or joined through one or more intermediate parts. Further, as employed herein, the statement that two or more parts are "attached" shall mean that the parts are joined together directly.

The disclosed concept is described in association with a three-pole circuit breaker, although the disclosed concept is applicable to a wide range of electrical switching apparatus having any suitable plurality of poles.

EXAMPLE 1

Figure 1:
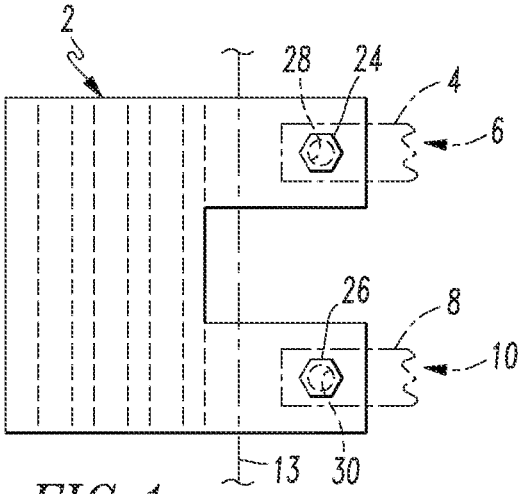
FIG. 1 is a plan view of a jumper for electrical connection between a terminal of one pole and a terminal of another pole of a plural-pole electrical switching apparatus in accordance with an embodiment of the disclosed concept.
Figure 2:
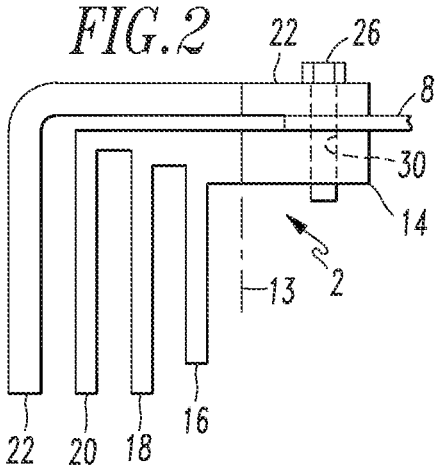
FIG. 2 is a vertical elevation view of the jumper engaging a terminal of one of the poles of the electrical switching apparatus of FIG. 1.

Referring to FIG. 1, a jumper 2 is for electrical connection between a terminal 4 (shown in phantom line drawing) of one pole 6 (shown in phantom line drawing) and a terminal 8 (shown in phantom line drawing) of another pole 10 (shown in phantom line drawing) of a plural-pole electrical switching apparatus (not shown, but see the three-pole circuit breaker 12 of FIGS. 8 and 9) having an outer surface 13 (shown in phantom line drawing). The example jumper 2 is a two-piece configuration that sandwiches each of the circuit breaker terminals 4,8, as shown in FIG. 2 with the terminal 8. One piece 14 has three example integral fins 16,18,20 and the other piece 22 is a single example fin. The one piece 14 with the three example integral fins 16,18,20 can be made with a suitable casting process. The two pieces 14,22 are bolted to the circuit breaker terminals 4,8 by bolts 24,26 (shown in phantom line drawing in FIG. 1) that pass through openings 28,30.

In Examples 1-4, the jumpers 2,32,42,52 are bolted to the circuit breaker terminals 4,8. Preferably, portions of these jumpers are threaded to act as nuts, although separate nuts (not shown) could alternatively be employed for the bolts 24,26.

EXAMPLE 2

Figure 3:
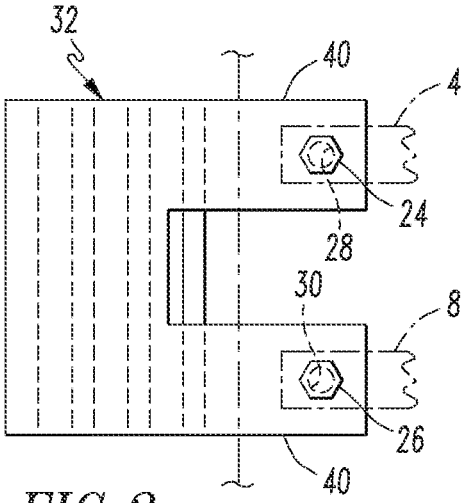
FIG. 3 is a plan view of a jumper for electrical connection between a terminal of one pole and a terminal of another pole of a plural-pole electrical switching apparatus in accordance with another embodiment of the disclosed concept.
Figure 4:
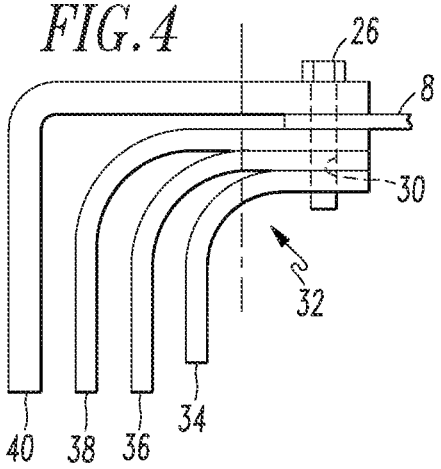
FIG. 4 is a vertical elevation view of the jumper engaging a terminal of one of the poles of the electrical switching apparatus of FIG. 3.

The example jumper 32 of FIGS. 3 and 4 is a four-piece configuration including four bent plates 34,36,38,40 (FIG. 4). In this configuration, the circuit breaker terminal 8 is sandwiched between the third and fourth plates 38,40. The four plates 34,36,38,40 and the circuit breaker terminals 4,8 (shown in phantom line drawing in FIG. 3) are secured together with bolts 24,26 (shown in phantom line drawing in FIG. 3). This configuration has a similar function and a similar performance as that of the configuration of Example 1, but is made by bending the plates 34,36,38,40, rather than with a casting.

The three plates 34,36,38 that are positioned on one side of the circuit breaker terminals 4,8 could alternatively be joined to ease assembly onto the circuit breaker terminals 4,8, but such joining is not needed for proper function.

As shown in FIG. 4, the circuit breaker terminals 4,8 are thin relative to the jumper 32. The thickness of the jumper 32 relative to the terminal thickness can be different for various circuit breakers. The example arrangement with the terminal 8 between plates 38 and 40 is believed to be the most efficient arrangement for heat transfer, although all four plates 34,36,38,40 could be on one side of the terminal 8 without a large reduction in performance.

EXAMPLE 3

The example jumper 42 of FIGS. 5 and 6 is a two-piece configuration including two separate pieces 44,46. Each of the circuit breaker terminals 4,8 (shown in phantom line drawing in FIG. 5) is sandwiched between the two jumper pieces 44,46, as shown with the terminal 8 in FIG. 6. This configuration provides relatively less effective heat transfer surface area within a relatively small space, but is relatively easier to make and use, while the jumpers 2,32 of Examples 1 and 2 provide relatively more heat transfer.

As shown in FIG. 6, the first piece 44 is a single first fin 44, and the second piece 46 is a single second fin 46. The single first fin 44 has an L-shape with two legs 47,48. The single second fin 46 has a U-shape with a first leg 49 and a second leg 50 having an L-shape. The leg 47 of the L-shape of the single first fin 44 is coupled to a portion 51 of the second leg 50 having the L-shape of the single second fin 46.

EXAMPLE 4

The example jumper 52 of FIG. 7 is a single-piece configuration, which can be machined or made with a casting process. This configuration provides a relatively large heat transfer surface area as compared to the configurations of Examples 1-3. However, in this specific example, due to fin efficiencies and air flow spacing, the example configuration of the jumper 52 does not provide as much heat transfer as the configurations of Examples 1-3. As a single-piece configuration, this provides ease of use by a customer and is easily bolted onto the circuit breaker terminals 4,8 (shown in phantom line drawing) by corresponding terminals 54,56. This configuration includes a plurality of heat transfer members 57 integral to the jumper 52.

EXAMPLE 5

The example jumpers 2,32,42,52 disclosed in connection with Examples 1-4 provide relative ease of manufacturing and use. However, it will be appreciated that these configurations can be modified by persons of ordinary skill in the relevant art to provide relatively greater heat transfer performance.

EXAMPLE 6

The disclosed jumpers 2,32,42,52 can be employed to electrically connect adjacent poles on one electrical switching apparatus, such as a circuit breaker.

For example and without limitation, two of the disclosed jumpers 2 electrically connect three poles 58,60,62 of the three-pole circuit breaker 12 in series, in order that a relatively higher voltage can be switched by the circuit breaker 12. For example, the upper (with respect to FIGS. 8 and 9) jumper 2 engages terminals 4,8 (shown in hidden line drawing) (see, also, the terminals 4,8 of FIGS. 1 and 2) of the poles 60,62, and the lower (with respect to FIGS. 8 and 9) jumper 2 engages terminals 4',8' (shown in hidden line drawing) (see, also, the terminals 4,8 of FIGS. 1 and 2) of the poles 58,60. Hence, two poles 58,60 are electrically connected in series by the lower (with respect to FIGS. 8 and 9) jumper 2, and two poles 60,62 are electrically connected in series by the upper (with respect to FIGS. 8 and 9) jumper 2, in order that the three poles 58,60,62 are electrically connected in series.

Figure 8:
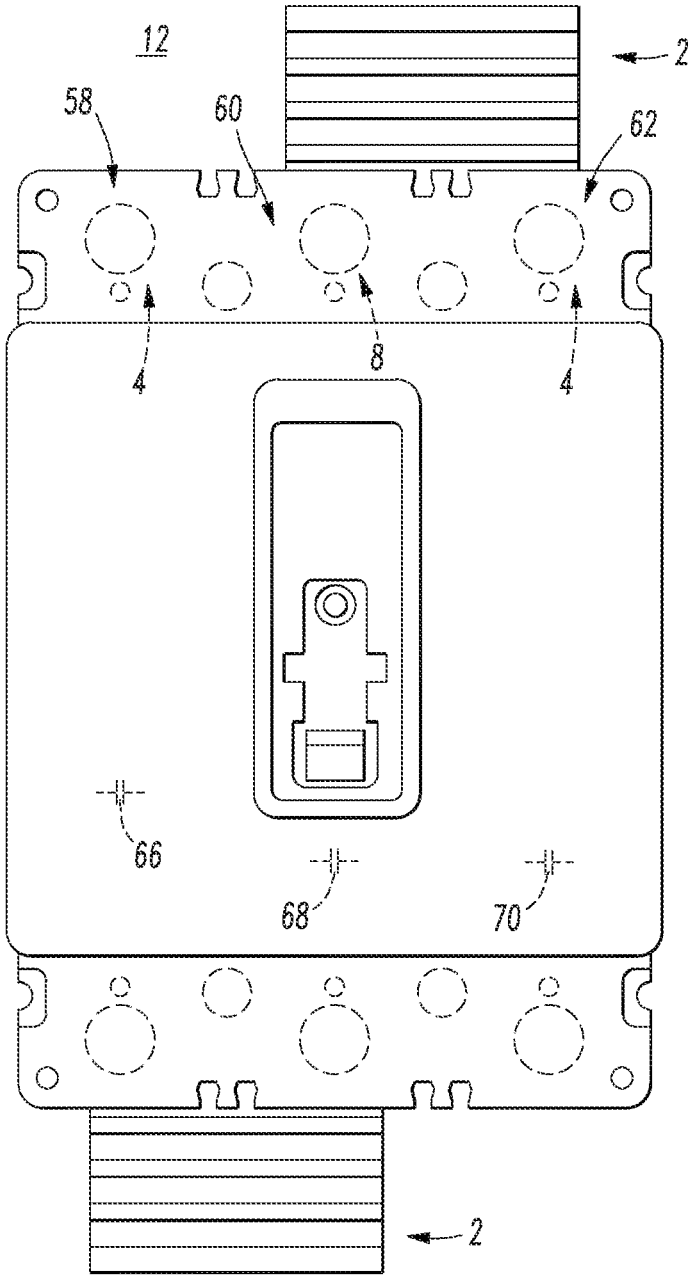
FIG. 8 is a vertical elevation view of a three-pole circuit breaker including two jumpers each of which engages a terminal of one of the poles and a terminal of another one of the poles in accordance with another embodiment of the disclosed concept.
Figure 9:
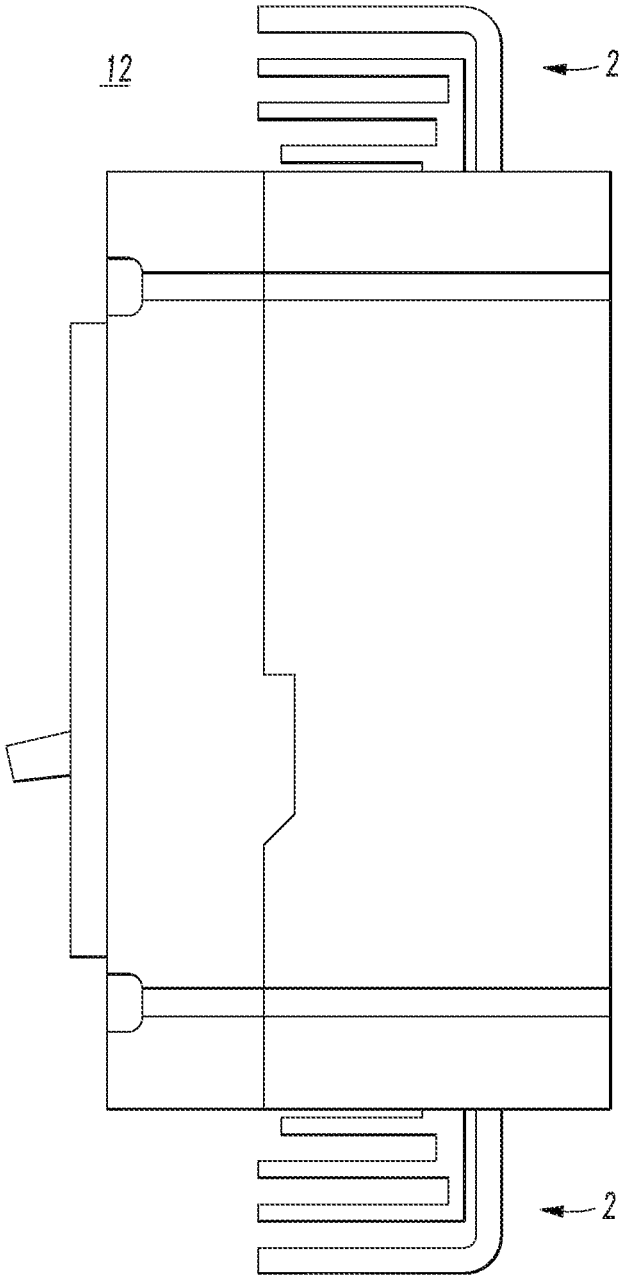
FIG. 9 is a side vertical elevation view of the three-pole circuit breaker and two jumpers of FIG. 8.

Each of the poles 58,60,62 includes a corresponding pair of separable contacts 66,68,70 (as shown in simplified form in the partially cut-away view of FIG. 8), respectively.

EXAMPLE 7

The disclosed jumpers 2,32,42,52 include multiple heat transfer members. Such heat transfer members can be provided by multiple plates (e.g., without limitation, 34,36,38,40 of FIG. 4) interleaved and bent to reduce the space occupied, or with the heat transfer members 57 of a solid block (e.g., without limitation, as shown with the jumper 52 of FIG. 7)

machined or cast, in order to provide the same functions of heat transfer and current carrying ability.

EXAMPLE 8

The disclosed jumpers 2,32,42,52 are made from a suitably electrically and thermally conductive material, such as copper or aluminum. An electrically insulating material 64 (e.g., without limitation, as partially shown in FIG. 7) can be coated on the members of the jumpers (e.g., without limitation, as shown with the jumper 52 of FIG. 7) in order to provide personnel protection from electrical shock. The jumpers can be made from multiple pieces or from a single piece of material.

EXAMPLE 9

The disclosed jumpers 2,32,42,52 preferably maximize the available heat transfer surface area while providing sufficient space for free air convection.

EXAMPLE 10

The disclosed phase jumpers 2,32,42,52 may have holes, slots or other suitable openings added to provide relatively more area for free air movement.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. An electrical switching apparatus comprising:

a plurality of poles, each of said poles comprising a terminal, the terminal of a first one of said poles being proximate the terminal of a second one of said poles;

a plurality of bolts: and a jumper electrically connected between the terminal of the first one of said poles and the terminal of the second one of said poles, said jumper comprising a plurality of heat transfer members, each of said heat transfer members including a first end and a second end distal from the first ends of said heat transfer members being connected to the terminal of a corresponding one of said poles by a corresponding one of said bolts, the second end of each of said heat transfer members being spaced apart from the second end of others of said heat transfer members, wherein said plurality of heat transfr members is at least three heat transfer members; wherein each terminal has a first side and a second side disposed opposite the first side; wherein one of said heat transfer members is mounted on the first side of the terminal; and wherein all of the others of said heat transfer members are mounted on the second side of the terminal.

2. The electrical switching apparatus of claim 1 wherein said plurality of heat transfer members are a plurality of conductive plates interleaved and bent in order to reduce size of said jumper.

3. The electrical switching apparatus of claim 1 wherein said jumper provides both a current carrying function and a heat transfer function.

4. The electrical switching apparatus of claim 1 wherein said jumper is made from an electrically and thermally conductive material.

5. The electrical switching apparatus of claim 4 wherein said electrically and thermally conductive material is selected from the group consisting of copper and aluminum.

6. The electrical switching apparatus of claim 1 wherein said jumper further comprises a plurality of surfaces coated with an electrically insulating material thereon.

7. The electrical switching apparatus of claim 1 wherein said jumper is made from a number of pieces of material,

8. The electrical switching apparatus of claim 1 wherein said jumper is made from a plurality of pieces of material.

9. The electrical switching apparatus of claim 1 wherein said jumper comprises a first piece and a second piece; and wherein each of the terminal of the first one of said poles and the terminal of the second one of said poles is sandwiched between the first piece and the second piece.

10. The electrical switching apparatus of claim 9 wherein said first piece and said second piece are bolted to both of the terminal of the first one of said poles and the terminal of the second one of said poles.

11. The electrical switching apparatus of claim 9 wherein said jumper comprises a first bent plate, a second bent plate, a third bent plate and a fourth bent plate, and wherein each of the terminal of the first one of said poles and the terminal of the second one of said poles is sandwiched between the third bent plate and the fourth bent plate.

12. The electrical switching apparatus of claim 11 wherein each of the terminal of the first one of said poles and the terminal of the second one of said poles is secured to the first bent plate, the second bent plate, the third bent plate and the fourth bent plate by a bolt.

13. The electrical switching apparatus of claim 11 wherein said first bent plate, said second bent plate and said third bent plate are joined together as a first piece; wherein said fourth bent plate is a second piece; and wherein each of the terminal of the first one of said poles and the terminal of the second one of said poles is sandwiched between the first piece and the second piece.

14. An electrical switching apparatus comprising:

a plurality of poles;

a plurality of pairs of separable contacts:

a plurality of terminals electrically connected to said pairs of separable contacts;

a plurality of bolts; and a number of jumpers electrically connected to at least some of said plurality of terminals, each of said number of jumpers electrically connecting two of said pairs of separable contacts in series, and each of said number of jumpers comprising a plurality of heat transfer members, each of said heat transfer members including a first end and a second end distal from the first end, the first ends of said heat transfer members being connected to the terminal of a corresponding one of said poles by a corresponding one of said bolts, the second end of each of said heat transfer members being spaced apart from the second end of others of said heat transfer members, wherein said plurality of heat transfer members is at least three heat transfer members; wherein each terminal has a first side and a second side disposed opposite the first side; wherein one of said heat transfer members is mounted on the first side of the terminal; and wherein all of the others of said heat transfer members are mounted on the second side of the terminal.

15. A jumper for an electrical switching apparatus comprising a plurality of poles and a plurality of bolts, each of said poles comprising a plurality of terminals, one of the terminals of a first one of said poles being proximate one of the terminals, one of the terminals of a first one of said poles being proximate one of the terminals of a second one of said poles, said jumper comprising:

a jumper member structured to be electrically connected between said one of the terminals of the first one of said poles and said one of the terminals of the second one of said poles, said jumper member comprising:

a plurality of heat transfer members, wherein each of said heat transfer members includes a first end and a second end distal from the first end, wherein the first ends of said heat transfer members are structured to be connected to the terminal of a corresponding one of said poles by a corresponding one of said bolts, wherein the second end of said heat transfer members is separated from the second end of others of said heat transfer members, and wherein said plurality of heat transfer members is at least three heat transfer members; wherein each terminal has a first side and a second side disposed opposite the first side; wherein one of said heat transfer members is mounted on the first side of the terminal; and wherein all of the others of said heat transfer members are mounted on the second side of the terminal.

* * * * *